United States Patent [19]

Hanaoka

[11] 4,396,904

[45] Aug. 2, 1983

[54] ELECTRONIC PACE TIMING DEVICE

[75] Inventor: Tadashi Hanaoka, Tanashi, Japan

[73] Assignee: Citizen Watch Company Limited, Tokyo, Japan

[21] Appl. No.: 251,029

[22] Filed: Apr. 1, 1981

[30] Foreign Application Priority Data

Apr. 4, 1980 [JP] Japan ..... 55-44105

[51] Int. Cl.[3] ..... G08B 1/00; A63B 7/06

[52] U.S. Cl. ..... 340/309.15; 340/323 R; 328/129.1; 368/89; 368/111; 368/243; 368/251; 377/5

[58] Field of Search ..... 340/309.1–309.5, 340/323 R, 384 E, 384 R, 309.15; 272/4; 368/49, 53, 60, 61, 89, 107, 109–112, 243, 244, 250, 251; 377/5; 328/129.1, 130.1

[56] References Cited

U.S. PATENT DOCUMENTS

| | | | |
|---|---|---|---|
| 3,893,099 | 7/1975 | Zoepfl | 340/323 R |
| 4,164,732 | 8/1979 | Pischiera | 340/309.1 |
| 4,282,513 | 8/1981 | Meisner et al. | 340/309.1 |

*Primary Examiner*—Donnie Lee Crosland
*Attorney, Agent, or Firm*—Jordan and Hamburg

[57] ABSTRACT

An electronic pace timing device whereby a physically perceptible pace timing signal can be repetitively generated, and whereby the repetition frequency of this pace timing signal can be set into the pace timing device as a numeric value, by actuation of external operating members. No calculations are performed in order to convert the numeric value specifying the repetition frequency of the pace timing signal into an actual pace timing signal, so that the overall circuit configuration can be very simple.

11 Claims, 6 Drawing Figures

| Fig. 5 A | Fig. 5 B |
|---|---|

ELECTRONIC PACE TIMING DEVICE

BACKGROUND OF THE INVENTION

The present invention relates to an electronic pace timing device, which generates physically perceptible pace timing signals at a desired presettable frequency. Such a pace timing device is widely used, to determine the rate at which various physical actions are repetitively performed. These physical actions are typified, for example, by the strides performed by a long-distance runner. During a long-distance race, it is necessary for each of the competitors to run at a pace which is best suited to his particular physical capabilities, with regard to the distance of the race. In order to determine this optimum running speed, it is necessary for the competitor to determine the relationship between running speed and the rate at which his physical capacities become exhausted. Once this has been done, the competitor can train by running at this speed, and can establish a plan for running throughout a long-distance race at that speed. A pace timing device is an extremely valuable device in the training of such a competitor, and can be used as a timing reference for measurement of running speed. Such a pace timing device generates a physically perceptible signal, e.g. an audible or visible signal, at a fixed repetition frequency. By adjusting his pace in accordance with the pace timing signals, the athlete can maintain his running speed at a desired fixed pace. In the case of a well-trained long-distance runner, the length of stride is extremely constant, so that if the number of strides per unit of time is constant, the running speed will also be constant.

In this regard, the time unit which is used to measure the running pace is an important factor. If, for example, a time unit of one hour is used, then the time required for measurement of running speed will be excessively long. If a time unit of one second is used, then there will be an insufficient number of strides during a measurement time interval, so that the accuracy of measurement will be low. For these reasons, a measurement time unit of one minute is generally adopted. During a one-minute interval, the pace of the runner will not vary by a significant amount, and the runner will perform at least one hundred strides or so during the time unit. Thus, long-distance runners generally measure their running speed in terms of the number of strides per minute. It should be noted that such a pace timing device can also be used in other spheres of physical activities, such as competitive swimmers, or rowers in a boat race. The rate of speed of a swimmer is generally measured in terms of the number of strokes per minute, while the speed of a boat competing in a boat race is usually measured as a number of oar strokes per minute. In the latter sports too, as in the case of long-distance running, it is desirable for the athletes to maintain a constant stroke repetition rate, in order to be able to produce the maximum possible physical effort over the duration of a long race.

It can thus be seen that a measurement time unit of one minute is highly suitable for a pace timing device which is applicable to various physical activities, and in particular to the training of athletic competitors. The applications of such pace timing devices are not limited to the sphere of sports, and they can also be used in some industrial activities, in order to conveniently set the rate at which some repetitively performed task is accomplished.

Hitherto, the most generally used type of pace timing device has been a metronome. However, such a mechanical type of pace timing device is inherently inaccurate, and is obviously not suited for use as a general pace timing device for competititive sports etc. Various types of electrical pace timing devices have been disclosed in the prior art. In one form of such a device, a dial provided with a graduated scale is used, whereby the repetition frequency can be adjusted by rotation of the dial to an appropriate position. As a result, the frequency of operation of an oscillator circuit (e.g. a resistance-capacitance or inductance-capacitance oscillator) is varied, to thereby change the frequency of an audible pace timing signal. Since the setting of the repetition frequency of the pace timing signal is performed in an analog manner, such pace timing devices are inherently of limited accuracy. It is possible to increase the setting accuracy by enlarging the dial, but this has the disadvantage of increasing the overall size of the pace timing device. Another disadvantage of such a prior art pace timing device is that changes in the value of the components determining the oscillator frequency will occur, as a result of temperature variations or long-term drift. Errors in the pace signal repetition frequency will therefore arise.

Another type of electrical pace timing device according to the prior art is based upon measurement of the period of an externally provided pace timing signal, memorizing this period information, and subsequently reproducing a pace timing signal having that period for its repetition frequency. The memorized period may be displayed by suitable display means, as can the pace timing signal repetition frequency. Such a method has the disadvantage however that it is necessary to provide an external source of a pace timing signal in order to produce a desired pace timing signal repetition frequency.

Another type of electrical pace timing device is based upon setting the repetition frequency of a pace timing signal as a digital numeric value, i.e. by input of digital signals. These digital signals may be input by various means such as a set of rotary switches, a ten-key switch pad (as in an electronic calculator), by repetitive actuation of a switch to produce successive input pulses, or by actuating a switch for a certain duration, during which input signal pulses are generated. The numeric value thus input, representing the pace timing signal repetition frequency can then be displayed by electro-optical display means. With such a device, the numeric value thus input is in the form of a frequency, i.e. a number of repetitions of the pace timing signal per minute. In order to produce a pace timing signal having that repetition frequency, it is necessary to convert the numeric value into a value representing the period of the desired repetition frequency. When this has been done, then a computation is carried out to determine the number of times by which the period of a standard frequency signal must be multiplied in order to produce the period of the desired pace timing signal repetition frequency. A pace timing signal having the desired repetition frequency can then be produced by frequency division of the standard frequency signal. This is the most accurate method of generating a pace timing signal of arbitrary frequency, particularly if the standard frequency signal source comprises a quartz crystal oscillator circuit. In this case, an accuracy of 0.01% or better can be attained for the repetition frequency of the pace timing signal. However, this method has the disadvantage that it is necessary to provide a quite extensive amount of circuitry in order to perform the calculations whereby a numeric value representing a pace timing signal repetition frequency is converted into period information. If the pace timing signal generating function is to be added to an electronic calculator as an added feature, there is no essential disadvantage to adopting the latter method. However, in the case of a device which is only to provide a pace timing function, or an electronic timepiece which is to have a pace timing function added to it, it is undesirable to provide circuitry simply to perform digital calculations, since various disadvantages such as increased cost and circuit complexity will result.

As described hereinafter, the present invention provides a pace timing device which has the advantages of accuracy and ease of input of a desired pace timing signal repetition frequency, provided by the latter-mentioned prior art pace timing device, but which does not require digital calculations to be performed upon an input numeric value representing the desired repetition frequency in order to produce a pace timing signal having that frequency. A pace timing device according to the present invention can therefore have a simple circuit configuration, enabling the manufacturing cost and power consumption of the device to be reduced by comparison with prior art electrical pace timing devices of digital type.

SUMMARY OF THE INVENTION

A pace timing device according to the present invention basically comprises means for inputting and storing a numeric value representing a desired pace timing signal repetition frequency, means for generating a relatively high frequency signal and a relatively low frequency signal, with the latter signal having a frequency of N pulses per minute, circuit means responsive to the memorized numeric value and to the relatively high and low frequency signals for producing successive groups of pulses, with each of these pulse groups containing a number of pulses identical to the numeric value stored and with the period between successive groups of pulses being equal to 1/N minutes, frequency divider means for dividing these groups of pulses by the frequency division factor N, to thereby generate output pulses at a repetition frequency of M pulses per minute, where M is the stored numeric value, and transducer means for producing physically perceptible pace timing signals at a repetition frequency controlled by the output pulses from the frequency divider means. The pace timing signals can be of audible or visible form. The means for producing successive pulse groups can comprise a counter circuit which is periodically reset to a count of zero, N times per minute, comparator circuit means for comparing the count in the counter with the stored numeric value, and gate circuit means contolled by the comparator circuit for interrupting the supply of clock pulses to the counter when the count therein becomes equal to the stored numeric value.

DESCRIPTION OF THE PREFERRED EMBODIMENTS

Figure 1:
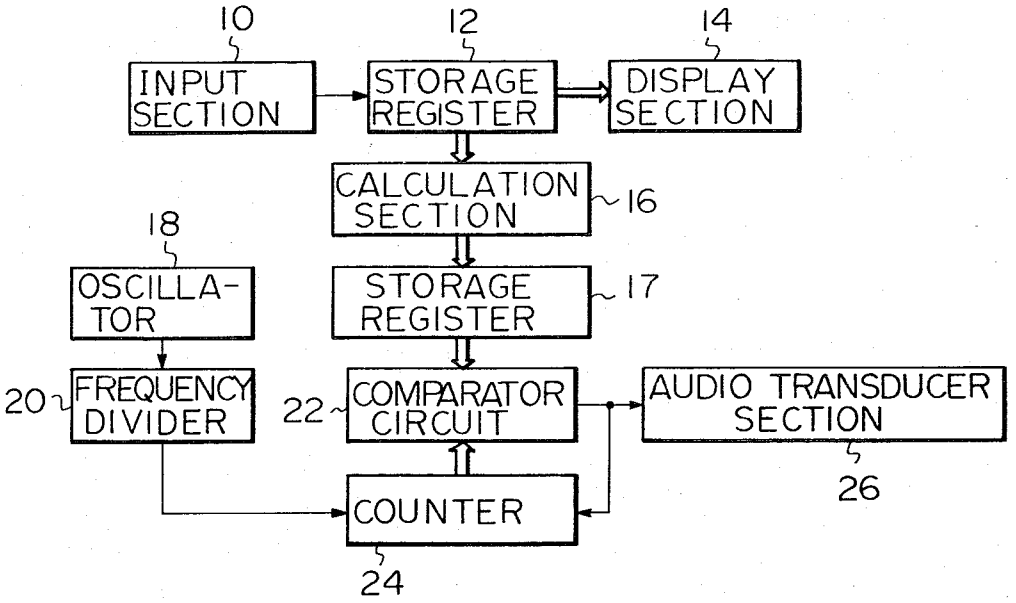
Fig. 1 (PRIOR ART)
FIG. 1 is a simplified block diagram of a prior art type of pace timing device in which digital calculations are performed in order to generate a desired pace timing signal repetition frequency.

Referring now to the appended drawings, FIG. 1 shows an embodiment of an electronic pace timing device according to the prior art, in simplified block diagram form. In FIG. 1, numeral 10 denotes an input section, which comprises means for inputting digital signals representing a numeric value which is equal to a desired number of repetitions of a pace timing signal during a predetermined time unit interval, e.g. one minute, i.e. a numeric value specifying a desired pace timing signal repetition frequency. This numeric value is stored in a first storage register 12, and is displayed by means of a display section 14. Various types of switches may be used in input section 10, such as a ten-key switch pad as commonly used in electronic calculators, or a set of rotary digital switches. Numeral 16 denotes a calculation section, which performs digital calculations upon the numeric value stored in register 12, as described hereinafter. The calculation results are transferred to a second storage register 17 and stored therein. Numeral 18 denotes an oscillator circuit which produces a standard frequency signal. This is applied to a frequency divider 20, to produce a reference frequency signal, comprising a train of pulses. This signal is input to a counter circuit 24, and counter therein. A comparator circuit 22 serves to compare the count value in counter circuit 24 with the numeric value held in register 17. When comparator circuit 22 detects that the count value in counter circuit is equal to the numeric value held in register 17, an output signal is produced by comparator circuit 22 and is applied to audio transducer section 26 whereby an audible pace timing signal is generated. The output signal from comparator circuit 22 is also applied as a reset signal to counter circuit 24, resetting the count therein to zero. In this way, pace timing signals are generating at a fixed repetition frequency, by audio transducer section 26. It should be noted that other means for generating pace timing signals can be used, such as light-emitting means for generating visible signals.

The calculation which must be performed by calculation section 16 in order to convert the numeric value stored in register 12 is as follows:

$$(\text{Register 12 contents}) = \frac{60.f}{K.\ (\text{Register 17 contents})} \qquad (1)$$

In the above equation, (Register 12 contents) denotes the numeric value which is stored in register 12, (Register 17 contents) denotes the numeric value to be stored in register 17, f is the oscillation frequency of oscillator 18, in units of Hz, and K is the frequency division ratio of frequency divider 20. By making the ratio f/K sufficiently high, the accuracy of the pace timing signals can be made as high as desired. However, such a pace timing device has the disadvantage that a relatively large amount of circuitry, with a correspondingly high level of power consumption is required to implement the calculator section, in order to perform the calculation required by equation (1 ) above in a digital manner. Thus, if it is required to form all or most of the pace timing device circuits by a single integrated circuit, the overall size of the integrated circuit chip (and hence its cost) will be substantially increased by the inclusion of the circuitry for calculation section 16.

Figure 2:
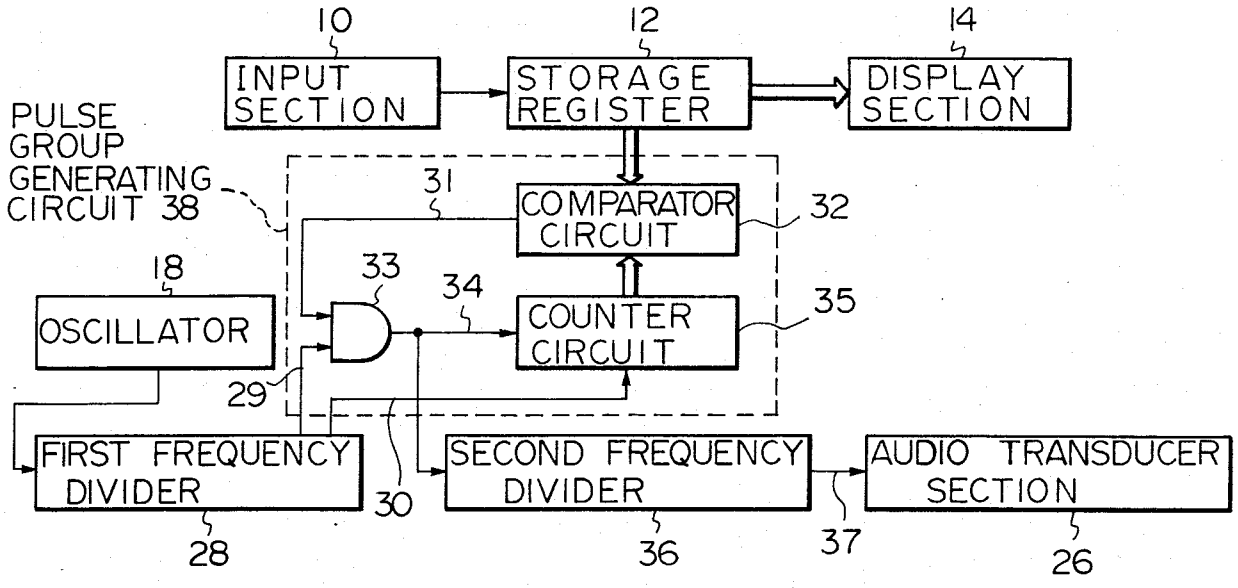
FIG. 2 is a simplified block diagram of a first embodiment of a pace timing device according to the present invention.

Referring now to FIG. 2, a first embodiment of a pace timing device according to the present invention is shown, in simplified block diagram form. Here, as in the prior art example of FIG. 1, numeral 10 denotes an input section whereby a numeric value representing a desired pace timing signal repetition frequency can be input to register 12 and stored therein, with the contents of register 12 being displayed by means of a display section 14. Input section 10 may comprise for example a ten-key switch pad, or a set of rotary digital switches. It should be noted that if a set of digital rotaty switches are used, then these may perform all of the functions required for input section 10, storage register 12, and also display section 14, with no other components required. Numeral 18 denotes an oscillator circuit which produces a standard frequency signal. Oscillator circuit 18 can be a quartz crystal oscillator, for maximum accuracy of pace signal generation, but may however be implemented by a resistance-capacitance oscillator. The standard frequency signal is input to a first frequency divider 28, which produces a first frequency division signal denoted by numeral 29, and a second frequency division signal denoted by numeral 30. The frequency division signal 30 from first frequency divider 28 comprises a train of N pulses per minute, with a fixed period, while frequency division signal 29, which is produced from an intermediate stage of frequency divider 28 is of substantially higher frequency than signal 30. The components shown within the dotted line outline denoted by reference numeral 38 consitute a pulse group generating circuit. This consists of a comparator circuit 32, an AND gate 33, and a counter circuit 35. The counter circuit 35 is periodically reset by pulses of frequency division signal 30, i.e. N times per minute. The frequency division signal 29 is applied through AND gate 33, when this gate is in the enabled condition, to be counted by counter circuit 35. The count contents of counter circuit 35 are compared with the contents of register 12, (which shall be referred to as the numeric value M where M is a positive integer) by comparator circuit 32. So long as the contents of counter 35 are different from the numeric value M stored in register 12, an output signal 31 from comparator circuit is at the "1" logic level, thereby enabling AND gate 33 to transfer the pulses of frequency division signal 29 to be counted by counter circuit 35. When coincidence is detected between the count in counter circuit 35 and the numeric value M is register 12, the output signal 31 from comparator circuit goes to the "0" logic level which inhibits AND gate 33 from further transferring frequency division signal 29 to be counted by counter 35. As a result, each time a pulse of frequency division signal 30 is produced, thereby resetting counter circuit 35, a group of pulses is output from AND gate 33, with the number of pulses in a group being equal to the numeric value M held in register 12. The successive groups of pulses thus output from AND gate 33, i.e. output from pulse group generating circuit 38, are applied to a second frequency divider 36. This performs frequency division by a factor 1/N. As described above, M pulses are output from AND gate 33 upon each pulse of frequency division signal 30, where M is the numeric value stored in register 12 and which specifies a number of pace signals to be generated per minute, so that a total of N.M pulses are input to the second frequency divider 36 per minute. Since these pulses are frequency divided by a factor 1/N, it will be apparent that M pulses are output from second frequency divider 36 per minute.

Figure 3:
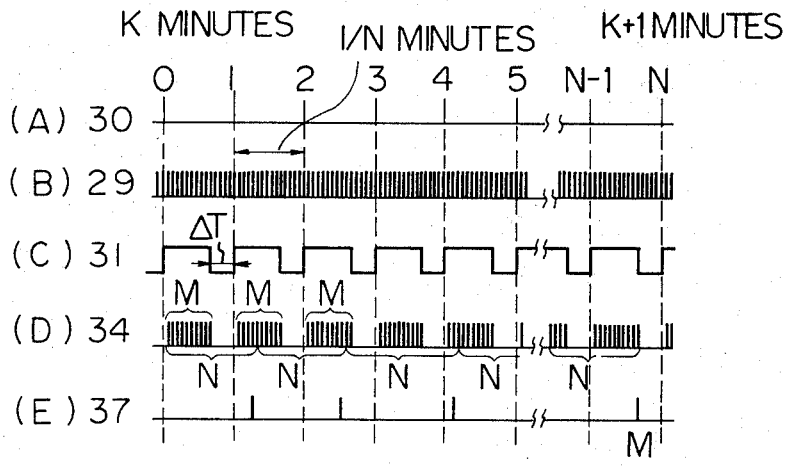
FIG. 3 is a timing diagram for illustrating the operation of a pace timing device according to the present invention.

The above description may be more easily understood by reference to the timing diagram of FIG. 3. Here, FIG. 3(A) denotes the waveform of frequency division signal 30, comprising N pulses during a typical one-minute interval extending from k to (k +1) minutes. FIG. 3(B) shows frequency division signal 29. FIG. 3(C) shows the output signal 31 from comparator circuit 32, and, as shown, this goes to the "0" logic level for a time interval $\Delta T$ between successive pulses of signal 30. FIG. 3(D) shows the waveform of the output signal from AND gate 33, which is the logical product of the output signal 31 from comparator circuit 32 and frequency division signal 29. As shown, output signal 34 from AND gate 33 comprises successive groups of pulses, each group containing M pulses, with the period between successive pulse groups being 1/N minutes, i.e. N pulse groups per minute. FIG. 3(E) shows the output signal 37 from second frequency divider 36, which comprises M pulses per minute. It should be noted that frequency division signal has a frequency which is an integral multiple of that of frequency division signal 30.

As can be seen from FIG. 3, the period between successive pulses of output signal 37 from second frequency divider 36 is not constant. This is becauses there can be either an odd number of transitions of signal 31 from the "1" logic level to the "0" logic level during an interval between two successive pulses of signal 37 (i.e. there is one transition of signal 31 to the "0" logic level during the interval between the first and second pulses of signal 37 shown in FIG. 3) or an even number of transitions of signal 31 from the "1" logic level to the "0" logic level during an interval between two successive pulses of signal 37 (e.g. there are two transitions of signal 31 from the "1" to the "0" logic level during the interval between the second and third pulses of signal 37 shown in FIG. 3). However, the variation in the number of such transitions of signal 31 between different periods of signal 37 cannot exceed one, so that the maximum variation which can occur in the period of signal 37 is limited to the amount $\Delta T$ shown in FIG. 3(C). It can be seen that as the numeric value M is increased, the size of the period fluctuation is decreased. It will also be apparent that, as the value of N is increased, the duration of T will also be decreased. For example, if frequency division signal 30 has a frequency of 16 Hz, then $N=16\times 60=960$, so that the period of signal 30 is 625 msec. Thus in this case, the maximum fluctuation of the period of signal 37, i.e in the period of the pace timing signal, must be less than 625 msec.

The relationship between the numeric value M and the quantity $\Delta T$, representing the maximum fluctuation of the period of pace timing signal generated by a pace timing device according to the present invention is very important. As stated, as the value of M is increased, the duration of T is decreased. If the maximum value of variations in the period of signal 37 were fixed, irrespective of the pace timing signal frequency, then it would be possible for these variations to become apparent to the user, with a high value of numeric value M, i.e. with a high pace timing signal frequency. However with a pace timing device according to the present invention this cannot occur, since as shown, an increase in the pace timing signal frequency causes a reduction of the maximum variation of the pace timing signal period. It should be noted that if N and M have a common factor, then the period of signal 37 will be absolutely constant.

The output pulses 37 from second frequency divider 36 are input to audio transducer section 26, to control the timing of audible pace timing signals generated by audio transducer section 26.

With a pace timing device according to the present invention, there are certain relationships between the frequency of first frequency division signal 29, i.e. N pulses per minute, and the numeric value M which specifies the pace timing signal repetition frequency. The maximum value of M is limited to the number of pulses of signal 29 contained in one period of signal 30, i.e. this determines the maximum number of pace signals generated per minute. Generally, the numeric value M will be set at about 250. Furthermore, for convenience of frequency division, the frequency of frequency division signal 29 should be $2^n$ times that of frequency division signal 30, where n is a positive integer. It is therefore convenient to make the frequency of signal 29 have a value 256 times that of frequency division signal 30. If this is done, and if the frequency of frequency division signal 30 is 16 Hz, then the frequency of signal 29 will be $256 \times N/60 = 4096$ Hz. In this case, the value of numeric value M can be selected within the range 0 to 255, or from 1 to 256, in 256 steps.

As stated above, increasing the value of N results in a decrease in the maximum amount of variation in the period of the pace timing signal. However if N is made excessively high, i.e. the frequency of signal 30 is made very high, then the power consumed by the circuits becomes excessive. Thus a value for N of $60 \times 2^4$ (i.e. the frequency of frequency division signal 30 is 16 Hz) or of $60 \times 2^5$ (i.e. the frequency of signal 30 is 32 Hz) is suitable generally speaking. The above considerations also apply to the case of a pace timing device which is to be incorporated into an electronic timepiece, as an additional function. In such a timepiece, frequencies having the relationship $2^R$ are generally available, where R is a positive integer, so that signals 29 and 30 are already available. A pace timing device according to the present invention can therefore be readily incorporated into an electronic timepiece, with only a small increase in the amount of circuit elements being required. It will often also be possible to utilize an alarm buzzer of the timepiece to produce audible pace timing signals, and to use time correction input switches for input section 10 of the pace timing function.

Figure 4:
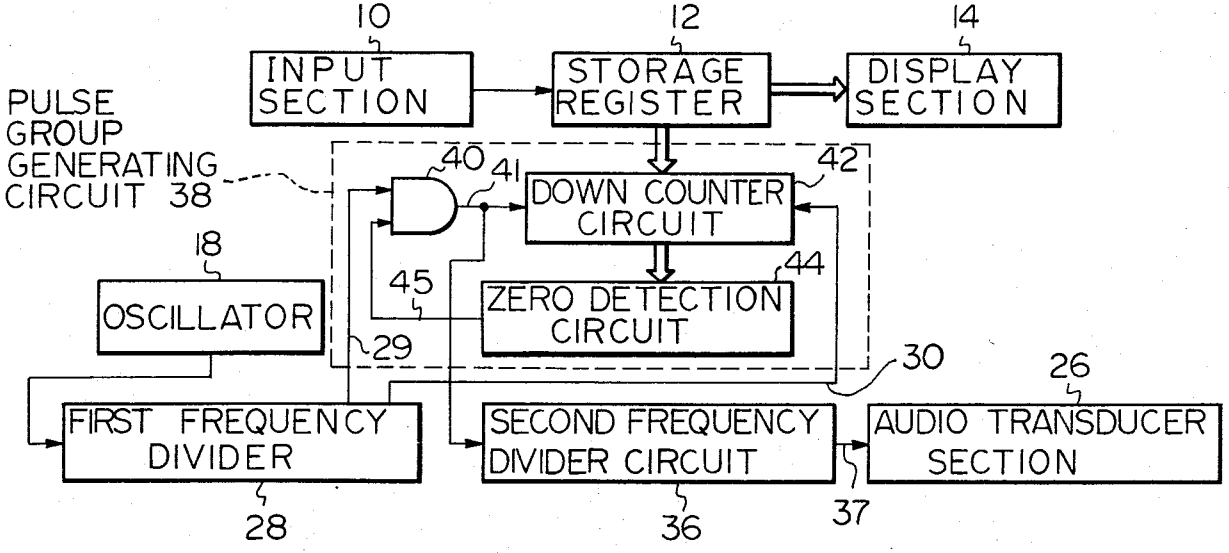
FIG. 4 is a simplified block diagram of a second embodiment of a pace timing device according to the present invention.

Referring now to FIG. 4, a second embodiment of a pace timing device according to the present invention is shown, in simplified block diagram form. In this embodiment the various blocks, i.e. input section 10, storage register 12, display section 14, oscillator 18, first frequency divider 28, second frequency divider 36, audio transducer section 26 and pulse group generating circuit 38 have the functions described for the first embodiment of FIG. 1. The differences between this embodiment and that of FIG. 1 lies in the configuration of pulse group generating circuit 38. In the embodiment of FIG. 4, this consists of an AND gate 40, a presettable down counter circuit 42, and a zero detection circuit 44. The timing diagram of FIG. 3 is also applicable to the embodiment of FIG. 4. The presettable down counter circuit 42 is preset with the numeric value M contained in storage register 12 by each pulse of signal 30 from frequency divider 28, i.e. the contents of register 12 are preset into presettable down counter circuit 42 N times per minute. When this is done, presettable down counter circuit 42 begins to count down from the preset numeric value, in response to pulses of first frequency division signal 29, applied as a clock signal through AND gate 40. When the contents of presettable down counter circuit reach zero, this is detected by zero detection circuit 44. Until the contents of presettable down counter circuit reach a value of zero, an output signal 45 at the "1" logic level is output therefrom, thereby enabling AND gate 40. When the contents of presettable down counter 42 reach a value of zero, then signal 45 from zero detection circuit 44 goes to the "0" logic level, thereby inhibiting AND gate 40 from further transfer of signal 29 to be counted by presettable down counter circuit 42. Subsequently, the next pulse of signal 30 from first frequency divider 28 again presets the numeric value M into presettable down counter circuit, and the process described above is repeated. In this way, successive groups of pulses, each comprising M pulses, are output from AND gate 40, i.e. are output from pulse group generating circuit 38. As for the first embodiment, the period between successive groups of pulses is 1/N minutes, i.e. N pulse groups are produced per minute. These pulse groups are input to second frequency divider 36, which performs frequency division by a factor 1/N, whereby an output pulse train 37 is produced. This is applied to audio transducer section 26, thereby causing a pace timing signal to be audibly emitted at the repetition frequency designated by numeric value M.

Figures 5, 5A:
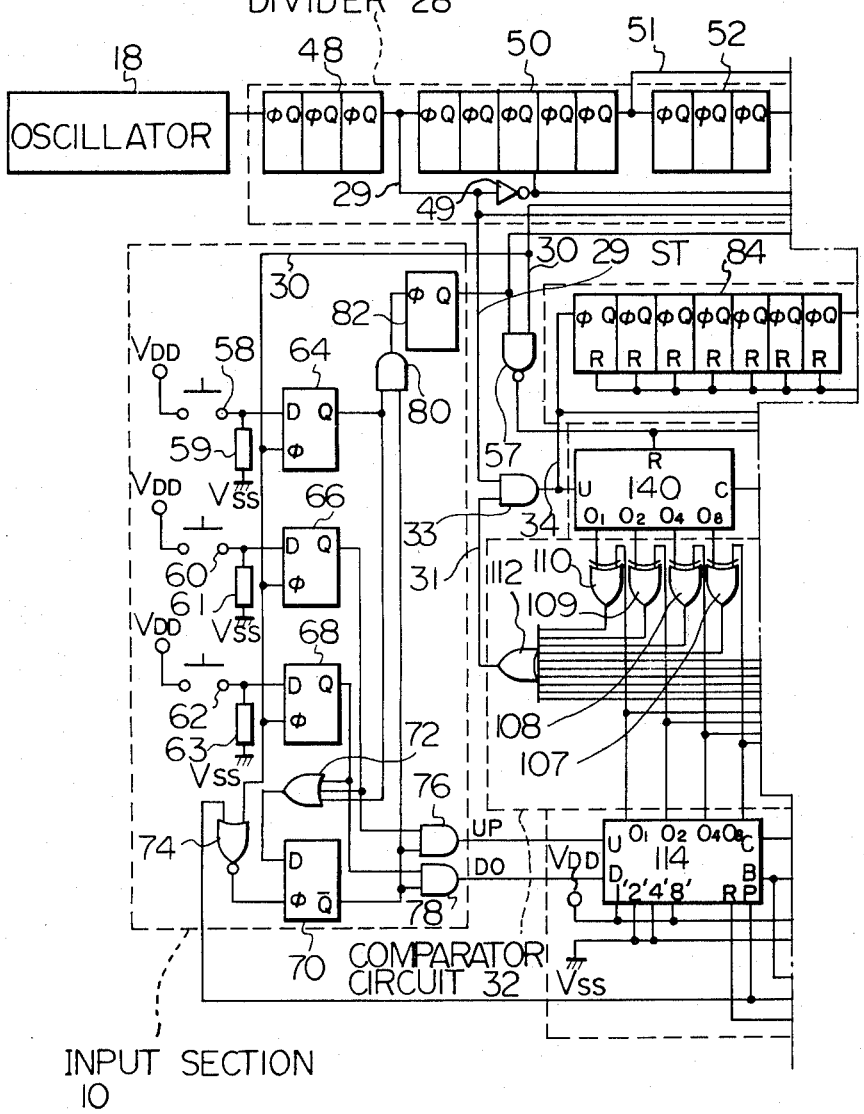
FIGS. 5A and 5B together are a circuit diagram of a pace timing device according to the present invention, having the basic configuration shown in FIG. 2.
Figure 5B:
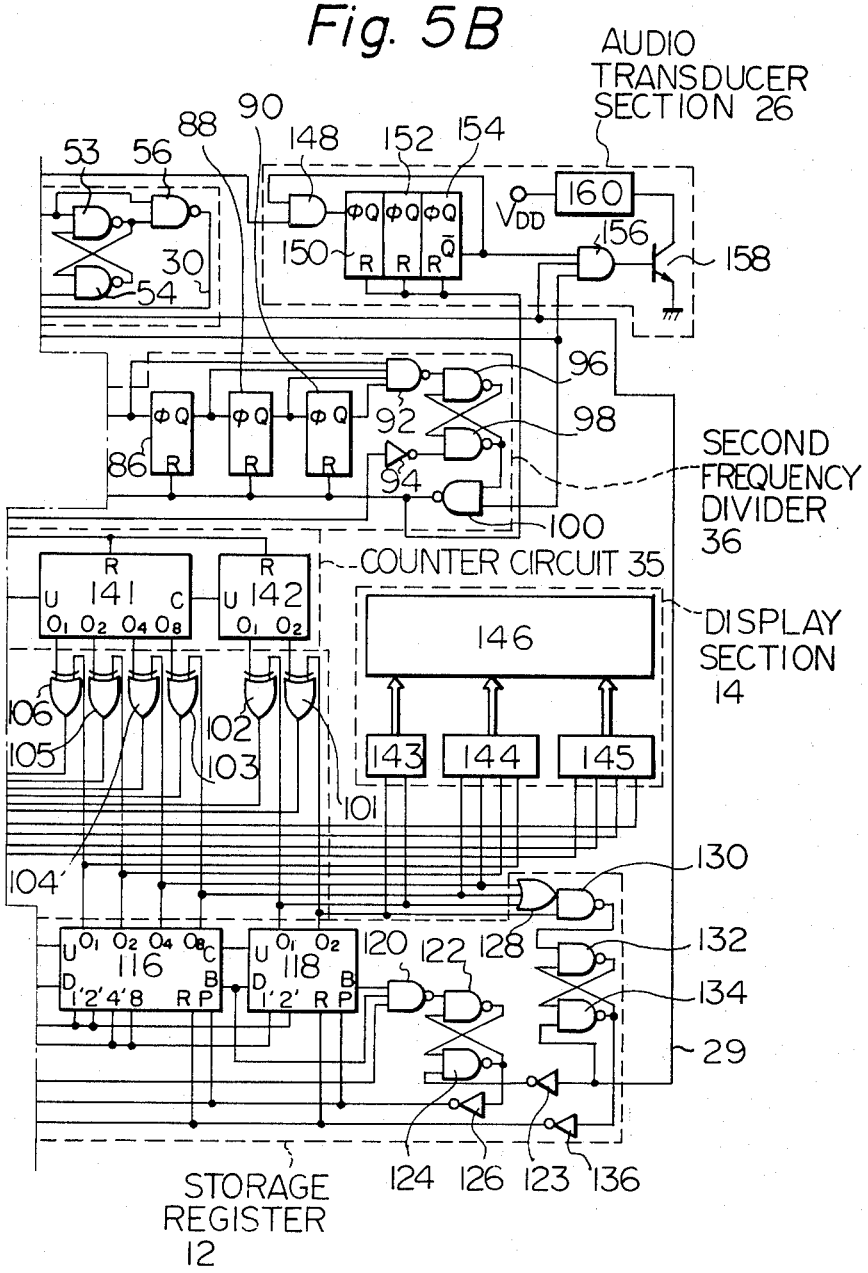

Referring now to FIGS. 5A and 5B, a circuit diagram is shown therein of an embodiment of a pace timing device according to the present invention, which is basically of the configuration shown in FIG. 2, i.e. in which pulse group generating circuit 38 includes a counter circuit and a comparator circuit. In FIG. 5, oscillator 18 comprises a quartz crystal oscillator circuit which produces a standard frequency signal of 32768 Hz. First frequency divider 28 comprises a set of three cascaded flip-flops denoted by numeral 48, which receive the standard frequency oscillator signal as input, and produce as output the first frequency division signal 29. This is in turn input to a set of five cascaded flip-flops denoted by numeral 50, which produce an output signal 51. This is to a set of three cascaded flip-flops denoted by numeral 52. All of the flip-flops in groups 48, 50 and 52 are of toggle-type, i.e. the Q output of each flip-flop changes over between the "1" and "0" logic levels on the rising edge of the signal applied to the clock input terminal $\phi$. The output signal from flip-flop group 52 is applied to a differentiator circuit comprising NAND gates 53, 54 and 56. This circuit serves to produce negative-going pulses of short pulse-width from the output of flip-flop group 52, these pulses constituting the second frequency division signal 30.

Input section 10 comprises a set of three externally actuated switches 58, 60 and 62, each of which is connected to a pull-down resistor 59, 61 and 63 respectively, and to the data input terminal of a data-type flip-flop 64, 66 and 68 respectively. Second frequency division signal 30 is applied as a clock signal to each of data-type flip-flops 64 to 68. The Q output of data-type flip-flop 64 is coupled to an input of an AND gate 80, and to an input of an OR gate 72. Similarly, the Q output of data-type flip-flop 66 is coupled to an input of OR gate 72 and to an input of an AND gate 76, while the Q output of data-type flip-flop 68 is coupled to one input of OR gate 72 and to an input of an AND gate 78. The output from OR gate 72 is coupled to the data input terminal of a data-type flip-flop 70, the $\overline{Q}$ output of which is coupled to inputs of AND gates 76, 78 and 80. Second frequency division signal 30 is applied through a NOR gate 74 as a clock input signal to data-type flip-flop 70. The output signals from AND gates 76 and 78 are designated as UP and DO respectively.

Storage register 12 comprises three up/down counter circuits 114, 116 and 118 respectively, which are of presettable type. Each of these up/down counter circuits is provided with up-count and down-count input terminals U and D, an up-carry and a down-carry output terminal C and D, a reset terminal R and a preset terminal P. The up/down counter circuits 114 and 116 are base-10 counters, which respectively serve to count the units and tens digits of the numeric value M, expressed as a decimal number, with the contents of each of these up/down counter circuits appearing in binary-coded decimal form on sets of data output terminals $O_1$, $O_2$, $O_4$ and $O_8$. The up/down counter circuit 118 is base-4 counter, which counts the hundreds digits of numeric value M, and whose contents appear in binary-coded decimal form on output terminals $O_1$ and $O_2$. Data can be set into up/down counter circuits 114 and 116 by means of data input terminals 1',2',4' and 8', and can be set into up/down counter circuit 118 by means of data input terminals 1' and 2'. The down-carry outputs from up/down counter circuits 114, 116 and 118 are each connected to one input of a NAND gate 120, the output of which is applied to an input of a NAND gate 122, which is cross-connected to another NAND gate 124 to form a latch circuit. The frequency division signal 29 is applied through an inverter 123 to an input of NAND gate 124. The output from NAND gate 124 is applied through an inverter 126 to the data preset terminal P of each of up/down counter circuits 114, 116 and 118. Register 12 further comprises two NAND gates 132 and 134, cross-coupled to form a latch circuit, an OR gate 128 and a NAND gate 130. NOR gate 128 receives the $O_1$ and $O_2$ output from counter 118, $O_8$ from counter 116, and $O_8$ and $O_4$ from up/down counter circuit 116. While NAND gate 130 receives the output from NOR gate 128 and the $O_2$ output from up/down counter circuit 118. The output from NAND gate 130 is coupled to an input of NAND gate 132, while first frequency division signal 29 is applied to an input of NAND gate 134.

Counter circuit 35 comprises three counter circuits, 140, 141 and 142. Counters 140 and 141 are base-10 counter circuits, while counter 142 is a base-4 counter circuit. The count contents of counters 140 and 141, which count the units and tens digits respectively, appear on outputs $O_1$,$O_2$, $O_4$ and $O_8$ in binary-coded decimal form. The contents of counter 142, which counts the hundreds digits, appears on data output terminals $O_1$ and $O_2$. Each of counter circuits 140 to 142 is provided with a count input terminal U and a carry output terminal C, whereby counter circuits 140, 141 and 142 are connected in cascade. Each counter circuit is also provided with a reset terminal R. The output of an AND gate 57 is connected to the reset terminals of counters 140, 141 and 142. NAND gate 57 receives as inputs the Q output from flip-flop 82, which is a control signal ST, and also the second frequency division signal 30. AND gate 33, which corresponds to the AND gate of the same numeral shown in FIG. 1, receives as input the first frequency division signal 29 and the output from comparator circuit 32. The comparator circuit 32 comprises a set of ten exclusive-OR gates, 101 to 110, which compare corresponding data outputs from up/-down counter circuits 114, 116 and 118 of register 12 and from counter circuits 140, 141 and 142 of counter 35. The outputs of these exclusive-OR gates are applied to inputs of an OR gate 112, the output of which corresponds to signal 31 in the embodiment of FIG. 2. This signal is applied to one input of AND gate 33.

Display section 14 comprises three sets of display driver/decoder circuits 143, 144 and 145, coupled to the the data output terminals of up/down counter circuits 114, 116 and 118 respectively. The output signals from these driver/decoder circuits are applied to drive an electro-optical display 146, whereby the contents of register 12 are displayed, i.e. the numeric value M is displayed.

The output signal from AND gate 33, i.e. signal 34, is input to second frequency divider circuit 36. This comprises a set of 7 cascaded flip-flop circuits 84, which receive signal 34 as input and produce an output signal which is applied to three cascaded flip-flop stages 86, 88 and 90. The output signals from flip-flop group 84 and from flip-flops 86 to 90 are input to a NAND gate 92, the output from which is applied to a latch circuit comprising NAND gates 96 and 98. Signal 34 is applied through an inverter 94 to the other input of this latch circuit. The circuit of second frequency divider 36 constitutes a base-960 counter, since when a count of 960 is attained, the output from NAND gate 92 goes to the "0" logic level, whereby a reset signal is applied from NAND gate 100 to reset all of the flip-flop stages 84 to 90.

The audio transducer section 26 comprises a timer circuit consisting of three series-connected flip-flops 150 to 154, and AND gates 148 and 156, together with an amplifier transistor 158 and a buzzer 160.

The operation of the circuit of FIG. 5 is as follows. When all of switches 58, 60 and 62 are in the open state, the data inputs of each of the data-type flip-flops 64, 66 and 68 are held at the zero logic level by pull-down resistors 59 to 63. The Q outputs of each of flip-flops 64 to 68 are thereby held at the "0" logic level and the output from OR gate 72 is also at the "0" logic level. Thus, the data input terminal of flip-flop 70 is at the "0" logic level. The $\overline{Q}$ output of data-type flip-flop is therefore at the "1" logic level. However, since the output of data-type flip-flop 70 is at "0" logic level, the outputs of AND gates 76, 78 and 80 are at the "0" logic level. In this condition, if switch 58 is closed, then a "1" logic level signal (i.e. the $V_{dd}$ supply potential) is applied to the data input of data-type flip-flop 64. The Q output from this flip-flop therefore goes to the "1" logic level, on the next transition of signal 30 to the "1" logic level. As a result, the output of AND gate 80 goes to the "1" logic level, as does the output from OR gate 72. Thus, the $\overline{Q}$ output from data-type flip-flop 70 goes to the "0" logic level upon the next falling edge of signal 30, i.e. when the output from NOR gate 74 goes from the "0" logic level to the "1" logic level. A single positive-going pulse, whose width is equal to the period of signal 30, is thereby generated by AND gate 80 each time switch 58 is actuated once. When switch 58 is opened thereafter, the $\overline{Q}$ output from data-type flip-flop 70 remains at the "0" logic level, so that the output from AND gate 80 remains at the "0" logic level. The operation of the circuits associated with switches 60 and 62 is identical to that described for switch 58. Thus, each time switch 60 is closed, a single positive-going pulse is generated by AND gate 76. Similarly, each time switch 62 is closed, a single positive-going pulse is generated from AND gate 78. Each time switch 58 is closed, an output pulse from AND gate 80 causes the logic state of the Q output from flip-flop 82 to be inverted. This output, i.e. signal ST, serves to determine whether the circuitry is in the operating or the non-operating state.

When signal ST is at the "0" logic level, then the outputs from NAND gates 57 and 100 are held at the "1" logic level. As a result, counter circuit 35 and flip-flops 150 to 154 of audio transducer section 26 are held in the reset state, while the output from AND gate 156 is also held at the "0" logic level. Thus, operation of buzzer 160 is inhibited. In this state, if switch 58 is actuated once, thereby causing signal ST to go to the "1" logic level, AND gate 57 becomes enabled, whereby signal 30 is transferred therethrough to periodically reset counter circuit 35, which can then count the pulses of signal 34. In addition, the operation of second frequency divider 36 and of audio transducer section 26 is now enabled, so that the pace timing device is now in the operating condition.

When switch 60 is closed, a single pulse is output from AND gate 76, forming the signal UP which is applied to the up-count input terminal of up/down counter circuit 114. Each time switch 62 is closed, a pulse is output from AND gate 78, as signal DO, which is applied to the down-count input of up/down counter circuit 114. Thus, by successive actuations of switch 60 or switch 62, the contents of register 12 can be incremented or decremented as desired, so that a desired value for numeric value M can be set therein.

OR gate 128 and NAND gate 130 of register 12 serve to detect when the contents of that register reach a value of 240 or above. When this is detected, the output from NAND gate 134 goes from the "1" logic level to the "0" logic level, whereby a signal at the "1" logic level is applied from inverter 136, to thereby reset the up/down counter circuits 114, 116 and 118 to a count of zero. NAND gate 150 serves to detect the condition in which the contents of up/down counter circuits 114 to 118 have reached zero while a down-count signal DO is being input. When this is detected, an output from NAND gate 120 causes the output of NAND gate 124 to go to the "0" logic level, whereby the output signal from inverter 126 causes predetermined numeric values to be set into the up/down counter circuits 114 to 118. The data input terminals 1', 2', 4' and 8' of up/down counter circuits 114 and 118 have the binary weighting factors 1, 2, 4 and 8 respectively, while the data input terminals 1' and 2' of up/down counter circuit 118 have the weighting factors 1 and 2. Thus, for the connections to the data input terminals of up/down counter circuits 114 to 118 shown in FIGS. 5A and 5B, the numeric values in these counters are set to 9, 3, and 2 respectively, representing a numeric value 239, when a preset signal is applied to the P terminals of these counter circuits.

With this embodiment, an up-count of register 12 occurs on the negative-going edge of each UP signal pulse, while a down-count occurs on the negative-going edge of each DO signal pulse. If the register contents reach zero during down-counting, they are reset to 239 and down-counting is continued. If the register contents reach a value of 239 during up-counting, they are reset to zero, and up-counting is continued.

In audio transducer section 26, flip-flops 152 to 154, in conjunction with AND gate 148, constitute a timer circuit which determines the duration of an audible tone generated as a pace timing signal by buzzer 160. If the device is in the operating condition, i.e. control signal ST is at the "1" logic level, then each output pulse of signal 37 from second frequency divider 36 resets the counter circuit formed by flip-flops 150 to 154. The $\overline{Q}$ output of flip-flop 154 thereby goes to the "1" logic level, enabling AND gate 148 to transfer the pulses of signal 51, from an intermediate stage of frequency divider 28, to be counted by flip-flops 150 to 154. When 4 of these pulses have been counted, the Q output of flip-flop 154 returns to the "0" logic level, thereby terminating counting. While the Q output of flip-flop 154 is at the "1" logic level, AND gate 156 is enabled to pass signal 29 to the base of amplifier transistor 158. The amplified pulses of signal 29 are thereby applied to drive buzzer 160, to generate an audible pace timing signal for a fixed time interval after each pulse of signal 37. In the present embodiment, signal 51 from first frequency divider 28 has a frequency of 128 Hz, so that the duration of each audible pace timing signal is approximately 4/128 seconds. Since the audible signal is modulated by signal 29, it has a frequency of 4096 Hz. The number of repetitions of this audible pace timing signal per minute is equal to the numeric value M which has been set into register 12, as described above.

In the present embodiment, the maximum value which can be set for numeric value M is 239. However, depending on the application of the pace timing device, a maximum value of 200 or less may be sufficient. In such a case, the limits of numeric value M can be from 0 to 199, allowing the circuitry to be simplified to some extent. For example, up/down counter circuit 118 can be replaced by a single flip-flop, as can counter circuit 142, while one of the two exclusive-OR gates 101 and 102 can be eliminated. In addition, it becomes unnecessary to provide circuit means for presetting the up/down counter circuits 114 and 116. The circuit of audio transducer section 26 could also be simplified if desired. In the present embodiment, control signal ST controls the operation of both counter circuit 35 and second frequency divider 36, as well as audio transducer section 26, so that audible pace signals of fixed duration are produced immediately after operation of the device is started by setting signal ST to the "1" logic level. However, it is also possible to control only the audio transducer section 26 by signal ST. In this case, each operation of the device is restarted by actuating switch 58, setting signal ST to the "1" logic level, the phase of the audible pace timing signals which are output will be unchanged from that of the previous period of operation.

From the above description of the preferred embodiments, it can be appreciated that a pace timing device according to the present invention provides a number of advantages. Since no arithmetic calculations are performed in order to convert a numeric value specifying a number of pace signal repetitions per unit of time, the circuit configuration can be simple and have a low level of power consumption. Thus, a pace timing device according to the present invention can be made compact and light in weight, and can easily be incorporated into an electronic timepiece, as an additional function, with only a relatively small increase in the amount of circuitry of the timepiece being required. Various methods of inputting the numeric value M specifying the pace signal repetition rate can be envisaged, however as shown by the preferred embodiments, this can conveniently be performed by a pair of switches. In addition, by providing a control switch whereby the operation of the device can be temporarily halted and the restarted, power consumption can be held to a minimum. It will also be appreciated that if a pace timing device according to the present invention is incorporated into an electronic timepiece having a digital electro-optical display, then the contents of register 12, i.e. the numeric value M, can be displayed thereby, through the provision of simple changeover switch means for selectively applying either time information or the contents of register 12 to the display. In addition, the standard frequency quartz crystal oscillator and the timekeeping frequency divider of the timepiece may be utilized as the oscillator 18 and first frequency divider 28 of the preferred embodiments, so that the additional circuit requirements will be minimal. Moreover, externally actuated switches used for time correction, dial lamp illumination, etc., may be used as the switches of input section 10 shown in FIG. 5, with the addition of suitable switch mode changeover means. Also, if the timepiece has an alarm function, then the alarm buzzer and its amplifier can be used as the buzzer 160 and amplifying transistor 158 shown in the embodiment of FIGS. 5A and 5B.

It should be noted that an electronic timepiece which incorporates a pace timing device according to the present invention has certain important advantages. Such a timepiece, in the form of a wristwatch, can be easily carried by a runner competing in a long-distance race, enabling the competitor to easily note the relationship between the time which has elapsed during the race and his running speed, i.e. number of strides per minute.

From the preceding description, it will be apparent that the objectives set forth for the present invention are effectively attained. Since various changes and modifications to the above construction can be made without departing from the spirit and scope of the present invention.

It is intended that all matter contained in the above description or shown in the accompanying drawings shall be interpreted as illustrative, and not in a limiting sense. The appended claims are intended to cover all of the generic and specific features of the invention described herein.

What is claimed is:

1. A pace timing device, comprising:

oscillator circuit means for generating a standard frequency signal;

first frequency divider means coupled to receive said standard frequency signal and responsive thereto for producing a first frequency division signal and a second frequency division signal having a frequency lower than that of said first frequency division signal, said second frequency division signal comprising N pulses per minute;

input means, for inputting electrical signals representing a numeric value M, where M is a positive integer;

memory means for memorizing said numeric value M from said input means;

pulse group generating circuit means coupled to receive said first and second frequency division signals and signals from said memory means representing said numeric value M, and responsive thereto for producing successive groups of pulses, each of said pulse groups comprising M pulses, and with the period between the initiation of each of successive ones of said pulse groups being equal to 1/N minutes;

second frequency divider means coupled to receive said groups of pulses from said pulse group generating circuit means and for performing frequency division thereon by a factor 1/N, for thereby producing output pulses at a frequency of M pulses per minute; and perceptible signal generating means coupled to receive said output pulses from said second frequency division means, for producing physically perceptible pace timing signals at timings controlled by said output pulses.

2. A pace timing device according to claim 1, in which N has a value of 960.

3. A pace timing device according to claim 1, in which N has a value of 1920.

4. A pace timing device according to claim 1, in which the value of M is within the range zero to 239.

5. A pace timing device according to claim 1, in which the value of M is within the range zero to 255.

6. A pace timing device according to claim 1, in which the value of M is within the range zero to 199.

7. A pace timing device according to claim 1, in which said pulse group generating circuit means comprises counter circuit means adapted to be reset to a count of zero in response to said second frequency division signal from said first frequency divider means, and comparator circuit means for comparing a count value in said counter circuit means with said numeric value M stored in said memory means to detect coincidence therebetween and for generating a coincidence detection signal when such coincidence is detected, and gate circuit means coupled to receive said first frequency division signal from said first frequency divider means, said gate circuit means serving to transfer said first frequency division signal as a clock input signal to said counter circuit means in the absence of said coincidence detection signal and being responsive to said coincidence detection signal for inhibiting the transfer of said first frequency division signal as a clock signal to said counter circuit means.

8. A pace timing device according to claim 1, in which said pulse group generating circuit means comprises a presettable down counter circuit which can be preset to the numeric value M which is stored in said memory means, at a timing determined under the control of second frequency division signal from said first frequency divider means, zero detection circuit means for detecting when the contents of said down counter circuit are zero and for producing a zero detection signal in response thereto, and gate circuit means coupled to receive said first frequency division signal from said first frequency divider means, said gate circuit means serving to transfer said first frequency division signal as a clock input signal to said down counter circuit means in the absence of said zero detection signal, and being responsive to said zero detection for inhibiting the transfer of said first frequency division signal as a clock signal to said down counter circuit means.

9. A pace timing device according to claim 7 or 8, in which the frequency of said first frequency division signal applied as a clock input signal has a value of 256×N/60 Hz.

10. A pace timing device according to claim 1, in which said memory means comprise an up/down counter circuit, and said input means comprise:

externally actuatable first switch means;

a flip-flop circuit responsive to successive actuations of said first switch means for alternately producing first and second output signals, said first output signal acting to establish an operating condition of said pace timing device and said second output signal acting to establish a non-operating condition of said pace timing device;

externally actuatable second switch means, responsive to actuation for producing a first switching signal, said memory means being responsive to said first switching signal for counting upward; and externally actuatable third switch means, responsive to actuation for producing a second switching signal, said memory means being responsive to said second switching signal for counting downward;

whereby a desired numeric value can be set into said memory means by appropriate actuations of said second and third switch means.

11. A pace timing device according to claim 1, in which said perceptible signal generation means comprises:

timer circuit means coupled to receive said first frequency division signal from said first frequency divider means;

gate circuit means coupled to receive an output signal from said timer circuit means, output pulses from said second frequency divider means, and a signal produced from said input section which selectively specifies an operating and a non-operating condition of said pace timing device;

amplifier circuit means responsive to an output signal produced from said gate circuit means for producing a drive signal; and an audio transducer responsive to said drive signal for producing audible pace timing signals.

* * * * *